US009109761B2

(12) United States Patent
Tsai et al.

(10) Patent No.: US 9,109,761 B2
(45) Date of Patent: Aug. 18, 2015

(54) LAMP MOUNTING BASE AND LIGHT EMITTING DIODE LAMP INCORPORATING THE SAME

(71) Applicant: ADVANCED OPTOELECTRONIC TECHNOLOGY, INC., Hsinchu Hsien (TW)

(72) Inventors: Ming-Ta Tsai, Hsinchu (TW); Min-Shun Yang, Hsinchu (TW); Yu-Wei Tsai, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 30 days.

(21) Appl. No.: 14/038,766

(22) Filed: Sep. 27, 2013

(65) Prior Publication Data

US 2014/0160748 A1 Jun. 12, 2014

(30) Foreign Application Priority Data

Dec. 6, 2012 (CN) ..... 2012 1 05178887

(51) Int. Cl.

| | |
|---|---|
| ***F21V 7/04*** | (2006.01) |
| ***F21K 99/00*** | (2010.01) |
| ***F21V 7/00*** | (2006.01) |
| *F21V 3/00* | (2015.01) |
| *F21Y 101/02* | (2006.01) |

(52) U.S. Cl.

CPC ..... *F21K 9/50* (2013.01); *F21V 7/0016* (2013.01); *F21V 3/00* (2013.01); *F21Y 2101/02* (2013.01)

(58) Field of Classification Search

CPC ..... F21V 7/00; F21V 7/0016; F21V 3/00; F21V 7/0058; F21V 7/0066; F21V 7/0083; F21K 9/50; F21K 99/00

USPC ..... 362/237, 241, 249.02, 249.06, 249.14, 362/255, 256, 297, 304, 346

See application file for complete search history.

(56) References Cited

U.S. PATENT DOCUMENTS

| | | | | |
|---|---|---|---|---|
| 8,100,557 | B2 * | 1/2012 | Chen et al. | 362/249.02 |
| 2010/0328938 | A1 | 12/2010 | Chen et al. | |
| 2011/0103054 | A1 * | 5/2011 | Chang et al. | 362/255 |
| 2011/0215345 | A1 * | 9/2011 | Tarsa et al. | 257/88 |

(Continued)

FOREIGN PATENT DOCUMENTS

| | | |
|---|---|---|
| CN | 101929623 A | 12/2010 |
| CN | 102269358 A | 12/2011 |

(Continued)

*Primary Examiner* — Y M Lee

(74) *Attorney, Agent, or Firm* — Novak Druce Connolly Bove + Quigg LLP

(57) ABSTRACT

An LED lamp includes a supporting base and a reflector having a plurality of reflecting tabs mounted thereon. The reflector includes many circumferentially arranged tabs around a central axis of the supporting base. Many LED light sources are mounted in the supporting base and divided into an outer array and an inner array. Each reflecting tab has a fixed end connected to the supporting base and a free end distant from the supporting base. Each reflecting tab extends upwardly and outwardly from a central portion of the supporting base toward an outer periphery thereof. The inner array of the LED light sources is surrounded by the reflector. A hole is defined in a free end of each reflecting tab and aligned with one of the LED light sources of the outer array. A lamp mounting base is also provided.

19 Claims, 5 Drawing Sheets

(56) References Cited

U.S. PATENT DOCUMENTS

| | | | |
|---|---|---|---|
| 2011/0234078 | A1 | 9/2011 | Choi et al. |
| 2012/0300453 | A1 | 11/2012 | Zhou et al. |

FOREIGN PATENT DOCUMENTS

| | | | |
|---|---|---|---|
| CN | 102661495 | A | 9/2012 |
| CN | 202511196 | U | 10/2012 |

* cited by examiner

LAMP MOUNTING BASE AND LIGHT EMITTING DIODE LAMP INCORPORATING THE SAME

TECHNICAL FIELD

The present disclosure relates generally to a lamp mounting base and a light emitting diode (LED) lamp incorporating the lamp mounting base, wherein the LED lamp has an improved illumination range.

DESCRIPTION OF RELATED ART

LEDs are solid state light emitting devices formed of semiconductors, which are more stable and reliable than other conventional light sources such as incandescent bulbs. Thus, LEDs are being widely used in various fields such as numeral/character displaying elements, signal lights, light sources for lighting and display devices.

Nowadays, LED lamps are commonly applied in general lighting. A traditional LED lamp includes a supporting base and a plurality of LED elements arranged thereon. Light emitted from the LED elements projects toward a front of the LED lamp, thereby leaving a rear and a periphery of the LED lamp not illuminated. Therefore, it is difficult for such an LED lamp to satisfy the requirements of uniform light distribution.

What is needed therefore is a lamp mounting base and an LED lamp incorporating the light source reflector which can overcome the above mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
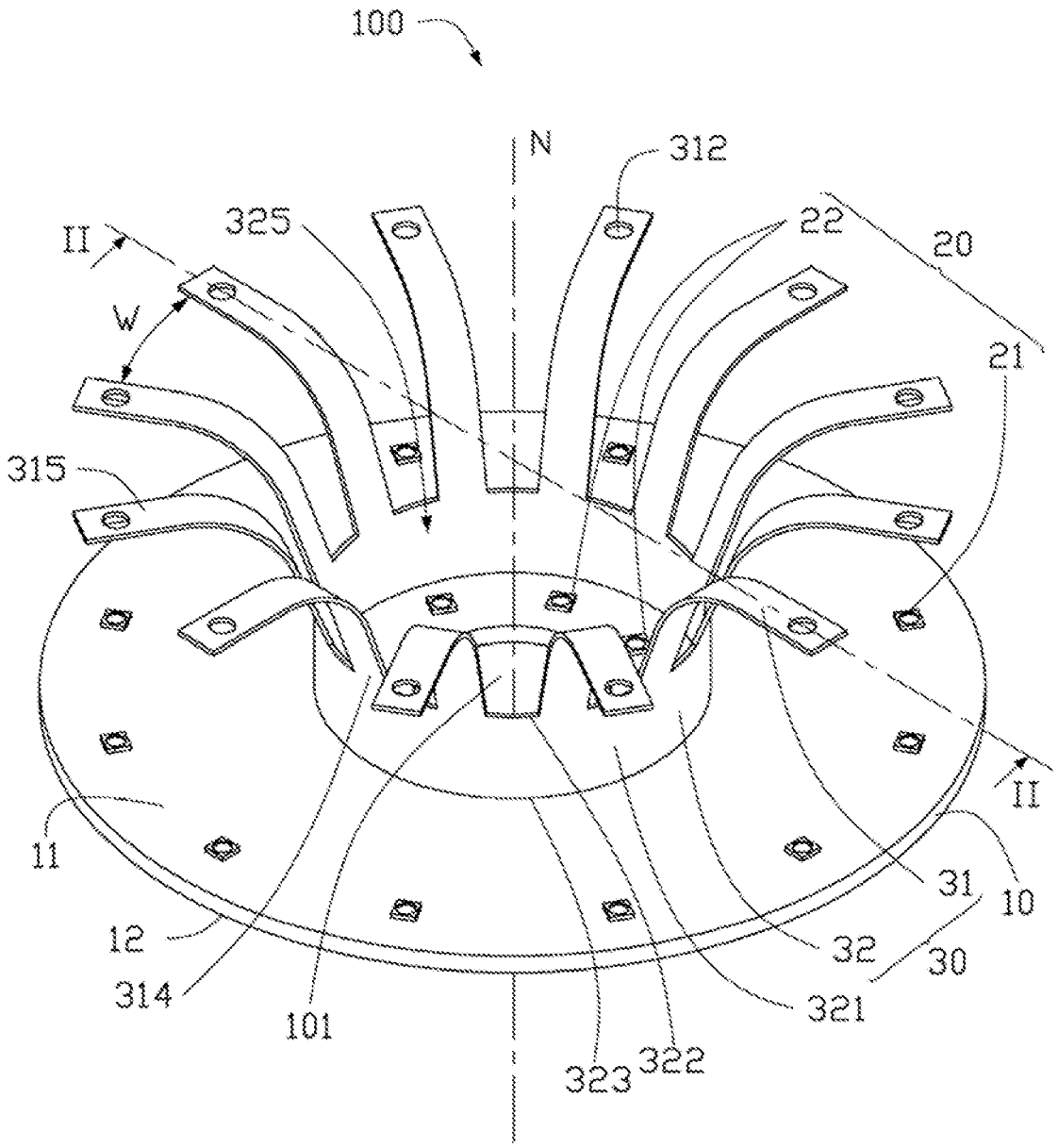
FIG. 1 is isometric, perspective view of an LED (light emitting diode) lamp in accordance with a first embodiment of the present disclosure.
Figure 2:
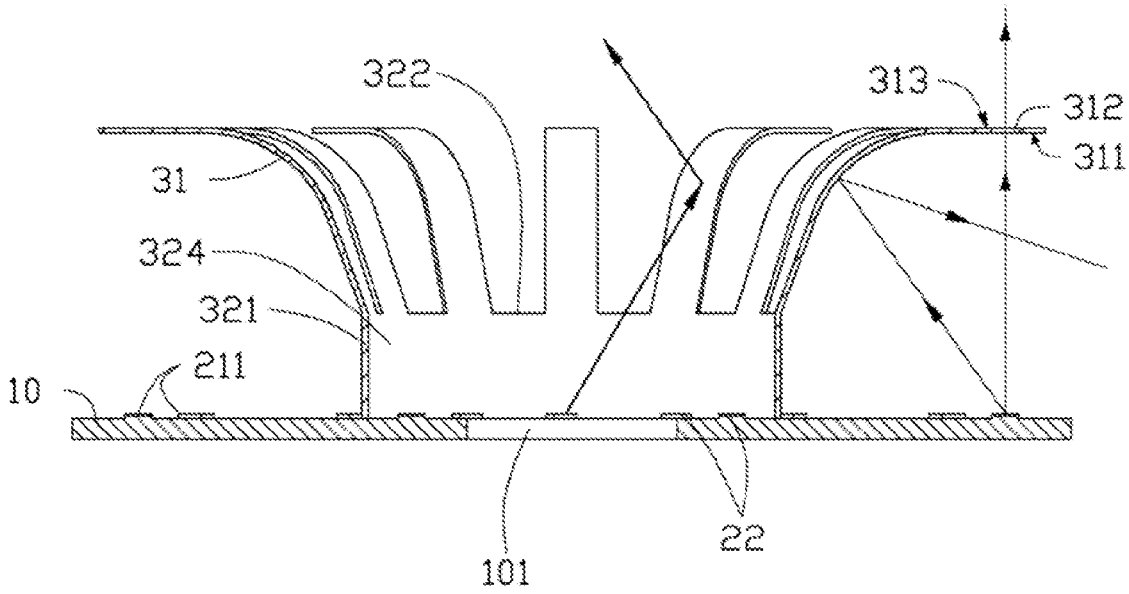
FIG. 2 is cross section view of the LED lamp of FIG. 1, taken along a line II-II thereof.

Referring to FIGS. 1 and 2, a light emitting diode (LED) lamp 100 in accordance with a first embodiment of the present disclosure includes a plurality of LED light sources 20, a supporting base 10 in which the LED light sources 20 are mounted and a light source reflector 30 in combination with the plurality of LED light sources 20 and the supporting base 10. The light source reflector 30 includes a plurality of reflecting tabs 31 and a connector 32 interconnecting the supporting base 10 and the plurality of reflecting tabs 31.

The supporting base 10 is disk-shaped. The supporting base 10 has a top face 11 and a bottom face 12 opposite to the top face 11. In the present embodiment, the top and bottom faces 11, 12 of the supporting base 10 are planar and parallel to each other. The top face 11 is coated with a reflective material so that the top face 11 is reflective. The supporting base 10 is radially symmetrical relative to a central axis N perpendicularly extending through a center of the supporting base 10.

The supporting base 10 defines a mounting hole 101 in the center thereof. The mounting hole 101 extends through the supporting base 10 from the top face 11 to the bottom face 12. The mounting hole 101 is circular and a center of the mounting hole 101 lies on the central axis N of the supporting base 10. The mounting hole 101 is configured for engaging with a screw or fastener to secure the LED lamp 100 to a mounting pole (not shown).

The connector 32 is fixed on the top face 11 of the supporting base 10. The connector 32 is located at a central portion of the top face 11 of the supporting base 10 and radially symmetrical relative to the central axis N of the supporting base 10.

The connector 32 is annular and includes a cylindrical wall 321 perpendicular to the top face 11 of the supporting base 10. Alternatively, the supporting base 10 and the connector 32 are integrally formed, whereby the cylindrical wall 321 extends upwardly from the central portion of the top face 11 of the supporting base 10.

The cylindrical wall 321 of the connector 32 has a bottom end 323 positioned on the top face 11 of the supporting base 10 and a top end 322 distant from the supporting base 10. An inner face 324 of the cylindrical wall 321 and the top face 11 of the supporting base 10 cooperatively define a receiving space 325.

The plurality of reflecting tabs 31 extends radially from the top end 322 of the cylindrical wall 321 of the connector 32. The plurality of reflecting tabs 31 are centrosymmetrically arranged around the central axis N of the supporting base 10. Each reflecting tab 31 has a fixed end 314 connected to the top end 322 of the cylindrical wall 321, and a free end 315 distant from the connector 32.

Each reflecting tab 31 extends outwardly from the top end 322 of the cylindrical wall 321 towards an outer periphery of the supporting base 10. Two adjacent reflecting tabs 31 are spaced from each other. In the present embodiment, each reflecting tab 31 is arc-shaped and has a uniform width. An arc radius of each reflecting path 31 is in a range from 5 mm (millimeter) to 10 mm (millimeter). Alternatively, the reflecting tab 31 is linear-shaped, which extends upwardly and outwardly from the top end 322 of the cylindrical wall 321.

A gap W between every two adjacent reflecting tabs 31 increases gradually along a direction from the fixed end 314 towards the free end 315 of each of the two adjacent reflecting tabs 31. The free end 315 of the reflecting tab 31 extends to reach a position above an outer periphery of the supporting base 10. Each reflecting tab 31 defines a guiding hole 312 in the free end 315 thereof. The guiding hole 312 extends through the reflecting tab 31. Alternatively, the free ends 315 of the plurality of reflecting tabs 31 extend beyond the outer periphery of the supporting base 10, and the guiding hole 312 is located between the fixed end 314 and the free end 315 of each reflecting tab 31. That is to say, the guiding hole 312 is located over the outer periphery of the supporting base 10.

The plurality of LED light sources 20 are arranged on the top face 11 of the supporting base 10. The plurality of LED light sources 20 includes a first annular LED light array 21 positioned at the outer periphery of the supporting base 10 and a second annular LED light source array 22 positioned at the central portion near the center of the supporting base 10. The supporting base 10 includes conductive patterns (not shown) formed on the top face 11 to electrically connect with the LED light sources 20 arranged thereon. The LED light sources 20 of the first and second annular LED light source arrays 21, 22 are electrically connected together in parallel or in series.

Each LED light source unit 211 of the first annular LED light source array 21 is located under a reflecting tab 31 and aligned with the guiding hole 312 of the reflecting tab 31. A size of the guiding hole 312 is smaller than that of the LED light source unit 211.

An orthographic projection of the free end 315 of each reflecting tab 31 on the top face 11 of the supporting base 10 completely covers a corresponding LED light source unit 211 of the first annular LED light source array 21 under the reflecting tab 31. It can be understood that, an orthographic projection of the guiding hole 312 of each reflecting tab 31 on the top face 11 of the supporting base 10 partially covers a corresponding LED light source unit 211 of the first annular LED light source array 21 under the reflecting tab 31.

Each reflecting tab 31 has a first reflecting surface 311 facing the top face 11 of the supporting base 10 and a second reflecting surface 313 opposite to the first reflecting surface 311. A part of light emitted from corresponding LED light source unit 211 under the reflecting tab 31 is reflected by the first reflecting surface 311 of the reflecting tab 31 toward a periphery and a rear of the LED lamp 100, with the remaining light emitted from corresponding LED light source unit 211 passing through the guiding hole 312 and the gap between every two adjacent reflecting tabs 31 to project toward a front of the LED lamp 100.

The second annular LED light source array 22 is received in the receiving space 325 and surrounded by the cylindrical wall 321 of the connector 32. The second annular LED light source array 22 is positioned on the central portion of the top face 11 of the supporting base 10 and surrounds the mounting hole 101 of the supporting base 10. A part of light emitted from the second annular LED light source array 22 is reflected by the second reflecting surface 313 of each reflecting tab 31 toward a front of the LED lamp 100.

Figure 3:
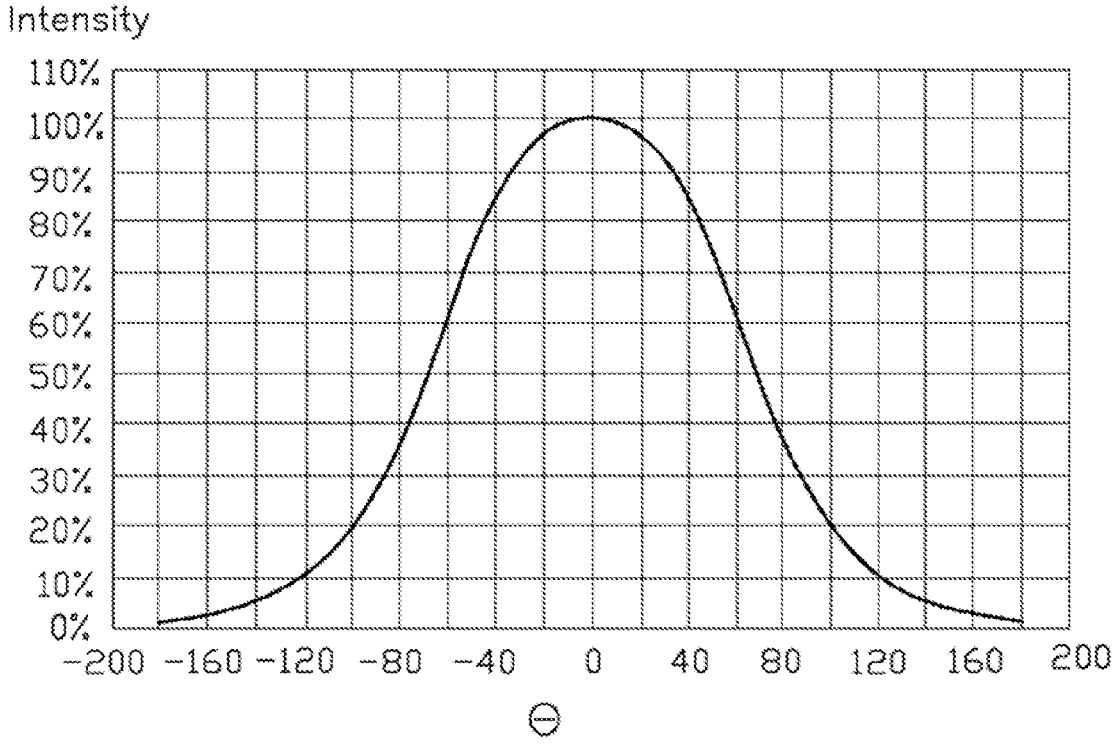
FIG. 3 is a light intensity distribution pattern of the LED lamp of FIG. 1, wherein a light source reflector of the LED lamp is removed.

Referring to FIG. 3, a light intensity distribution pattern of the LED lamp 100 without the reflector 30 is shown. A horizontal axis shown in FIG. 3 represents a light emitting angle of the LED lamp 100 without the reflector 30 and a vertical axis represents a light intensity, wherein 0 degree means where the central axis N of the LED lamp 100 without the reflector 30 is located. As light ray emitted from the LED lamp 100 without the reflector 30 completely projects toward front of the LED lamp 100 without the reflector 30, a forward half maximum (FWHM) angle of the LED lamp 100 without the reflector 30 is only 140 degrees.

Figure 4:
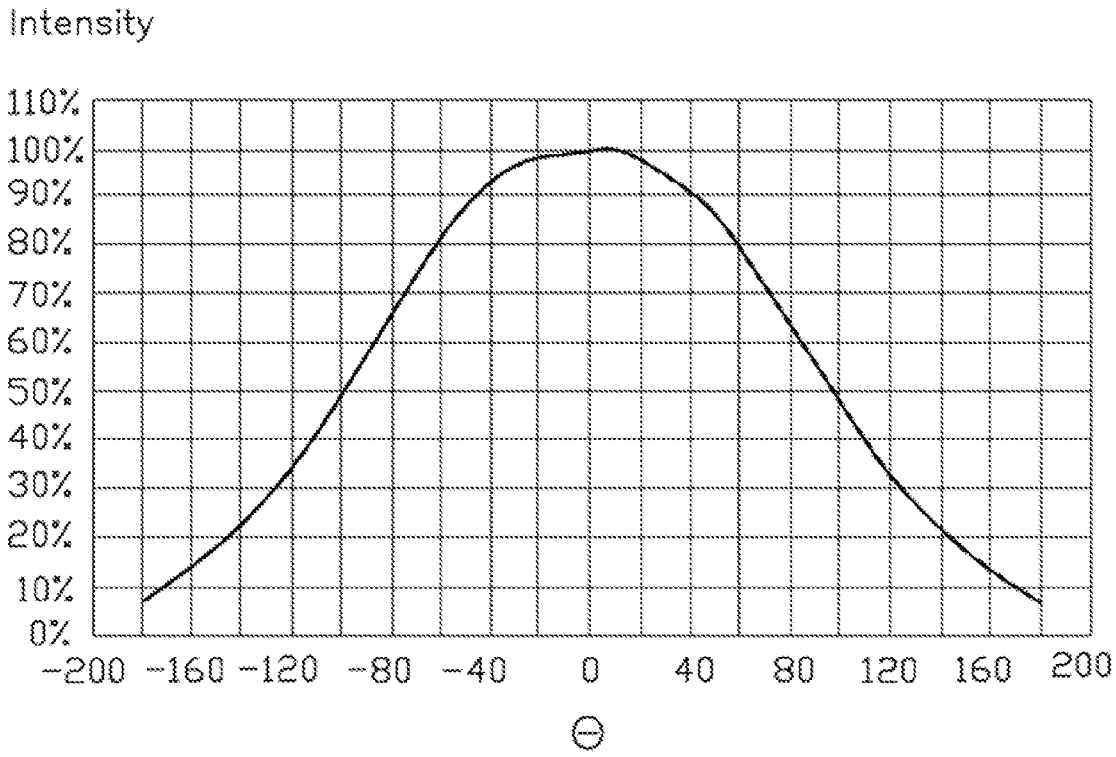
FIG. 4 is a light intensity distribution pattern of the LED lamp of FIG. 1.

Referring to FIG. 4, different from the light intensity distribution pattern of the LED lamp 100 without the reflector 30 shown in FIG. 3, a forward half maximum (FWHM) angle of the LED lamp 100 in the present disclosure reaches 198 degrees, and almost 10% of the total luminous flux emitted from the LED lamp 100 exists within a forward angle larger than 344 degrees.

Figure 5:
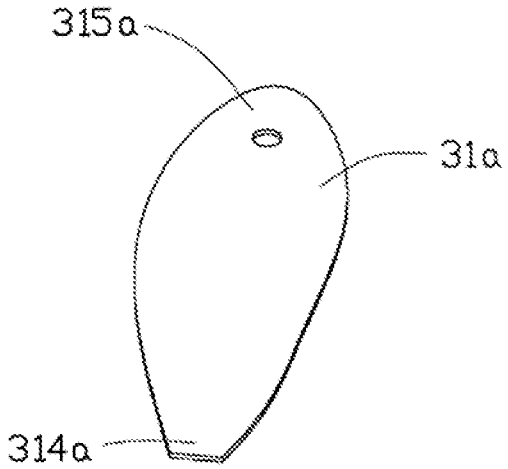
FIG. 5 is perspective view of a reflecting tab of a light source reflector in accordance with a second embodiment of the present disclosure.

Referring to FIG. 5, a reflecting tab 31*a* of a light source reflector in accordance with a second embodiment of the present disclosure is illustrated. The reflecting tab 31*a* is arc-shaped. And a width of the reflecting tab 31*a* increases firstly and then decreases gradually from a fixed end 314*a* to a free end 315*a* of the reflecting tab 31*a*. Accordingly, a gap between every two adjacent reflecting tabs 31*a* decreases firstly and then increases gradually from the fixed end 314*a* to the free end 315*a* of the reflecting tab 31*a*.

In the present disclosure, a part of light emitted from the plurality of LED light sources 20 is reflected by the reflector 30 toward a backside of the LED lamp 100; thus the LED lamp 100 has a wide illumination range.

It is to be understood that the connector 32 is optional in the present disclosure. The plurality of reflecting tabs 31 can be directly fixed to the supporting base 10 and positioned in a circle around the central axis N of the supporting base 10. In addition, the number of the reflecting tab 31 can vary according to the actual requirements. It can be further appreciated that the LED lamp 100 can further include a transparent sheath to cover the LED light sources 20 and the reflector 30, thereby preventing dust or moisture in the outside of the LED lamp 100 from adversely affecting the LED light sources 20.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A lamp mounting base comprising:

a supporting base having a top face and a bottom face opposite to the top face thereof, the top face of the supporting base being configured for mounting a plurality of LED light sources therein which are divided into an outer array and an inner array; and a plurality of reflecting tabs circumferentially arranged around a central axis of the supporting base and configured to surround the inner array of the LED light sources, each reflecting tab having a fixed end connected to the supporting base and a free end distant from the supporting base;

wherein each reflecting tab extends upwardly and outwardly from a central portion of the top face of the supporting base toward an outer periphery of the supporting base, and the reflecting tabs are spaced from each other; and wherein each reflecting tab defines a guiding hole in the free end, and the guiding hole extends through the reflecting tab and is configured for aligning with a corresponding LED light source of the outer array of the LED light sources.

2. The lamp mounting base of claim 1, wherein the fixed ends of the plurality of reflecting tabs are directly fixed to the supporting base and positioned in a circle around the central portion of the top face of the supporting base.

3. The lamp mounting base of claim 1, further comprising a connector interconnecting the fixed ends of the plurality of reflecting tabs and the top face of the supporting base.

4. The lamp mounting base of claim 3, wherein the connector is annular and comprises a cylindrical wall perpendicular to the top face of the supporting base.

5. The lamp mounting base of claim 4, wherein the plurality of reflecting tabs extends from a top end of the cylindrical wall of the connector.

6. The lamp mounting base of claim 4, wherein an inner face of the cylindrical wall of the connector and the top face of the supporting base cooperatively define a receiving space.

7. The lamp mounting base of claim 1, wherein the supporting base defines a mounting hole at a center thereof, the mounting hole extends through the supporting base from the top face to the bottom face, and the plurality of reflecting tabs are positioned around the mounting hole.

8. The lamp mounting base of claim 1, wherein each reflecting tab is arc-shaped or linear-shaped.

9. The lamp mounting base of claim 8, wherein each reflecting tab has a uniform width.

10. The lamp mounting base of claim 8, wherein a width of each reflecting tab increases firstly and then decreases gradually along a direction from the fixed end towards the free end of each reflecting tab.

11. An LED (light emitting diode) lamp, comprising:

a supporting base having a top face and a bottom face opposite to the top face thereof;

a light source reflector and a plurality of LED light sources coupled to the top face of the supporting base;

wherein the light source reflector has a plurality of reflecting tabs circumferentially arranged around a central axis of the supporting base perpendicular to the supporting base, each reflecting tab having a fixed end connected to the supporting base and a free end distant from the supporting base;

wherein each reflecting tab extends upwardly outwardly from a central portion of the top face of the supporting base toward an outer periphery of the supporting base and the reflecting tabs are spaced from each other;

wherein the plurality of LED light sources are arranged on the top face of the supporting base and an orthographic projection of at least one of the reflecting tabs on the top face of the supporting base covers one of the LED light sources;

wherein the plurality of LED light sources comprises a first annular LED light source array positioned near an outer periphery of the supporting base, and each LED light source unit of the first annular LED light source array is located under a corresponding one of the reflecting tabs; and wherein each reflecting tab defines a guiding hole in the free end, and the guiding hole extends through each reflecting tab and is aligned with a corresponding one of the LED light sources under each reflecting tab.

12. The LED lamp of claim 11, wherein each reflecting tab has a first reflecting surface facing toward the top face of the supporting base, and a part of light emitted from first annular LED light source array under the reflecting tabs is reflected by the first reflecting surface of each reflecting tab toward a rear of the LED lamp.

13. The LED lamp of claim 12, wherein the plurality of LED light sources comprises a second annular LED light source array positioned near a center of the supporting base, and the second annular LED light source array is surrounded by the plurality of reflecting tabs.

14. The LED lamp of claim 13, wherein each reflecting tab has a second reflecting surface opposite to the first reflecting surface thereof, and a part of light emitted from the second annular LED light source array is reflected by the second reflecting surface of each reflecting tab toward a front of the LED lamp.

15. The LED lamp of claim 13, wherein the light source reflector further comprises a connector located between the fixed ends of the plurality of reflecting tabs and the top face of the supporting base, and wherein the connector connects the plurality of reflecting tabs to the supporting base.

16. The LED lamp of claim 15, wherein the connector is annular and comprises a cylindrical wall perpendicular to the top face of the supporting base, and an inner face of the cylindrical wall of the connector and the supporting base cooperatively define a receiving space for receiving the second annular LED light source array therein.

17. The LED lamp of claim 11, wherein each reflecting tab is arc-shaped and has a uniform width.

18. The LED lamp of claim 17, wherein a width of each reflecting tab increases firstly and then decreases gradually along a direction from the fixed end towards the free end of each reflecting tab.

19. The LED lamp of claim 11, wherein each reflecting tab is linear-shaped.

* * * * *